United States Patent [19]

Lowry

[11] Patent Number: 4,501,345

[45] Date of Patent: Feb. 26, 1985

[54] ELEVATOR SYSTEM

[75] Inventor: James Lowry, Hicksville, N.Y.

[73] Assignee: Westinghouse Electric Corp., Pittsburgh, Pa.

[21] Appl. No.: 557,791

[22] Filed: Dec. 5, 1983

[51] Int. Cl.[3] ..... B66B 1/40

[52] U.S. Cl. ..... 187/29 R

[58] Field of Search ..... 187/29

[56] References Cited

U.S. PATENT DOCUMENTS

| | | | |
|---|---|---|---|
| 3,786,929 | 1/1974 | Hathcock, Jr. | 187/29 X |
| 3,815,711 | 6/1974 | Hoelscher | 187/29 |
| 4,046,229 | 9/1977 | Kernick et al. | 187/29 |
| 4,102,436 | 7/1978 | Kernick et al. | 187/29 |
| 4,155,426 | 5/1979 | Booker, Jr. | 187/29 |
| 4,354,576 | 10/1982 | Kajiyama | 187/29 |
| 4,463,833 | 8/1984 | Ludwig et al. | 187/29 |

*Primary Examiner*—J. V. Truhe
*Assistant Examiner*—W. E. Duncanson, Jr.
*Attorney, Agent, or Firm*—D. R. Lackey

[57] ABSTRACT

An elevator system, and methods of providing certain functions thereof, wherein an up/down counter provides a count which is used to provide a landing and leveling speed pattern for the elevator car. The counter is preset to a predetermined count prior to entering the landing zone of a target floor, and distance pulses, generated in response to car movement in the landing zone decrement the count when the car moves toward the target floor, and in the event the car overshoots the floor, the distance pulses increment the count while the car is moving away from the floor in the landing zone.

13 Claims, 8 Drawing Figures

ELEVATOR SYSTEM

BACKGROUND OF THE INVENTION

1. Field of the Invention

The invention relates in general to elevator systems, and more specifically to new and improved apparatus and methods for generating a landing and leveling speed pattern for elevator systems.

2. Description of the Prior Art

A speed pattern for an elevator car is usually time based until the car reaches a distance from the target floor at which it must start the slowdown phase of the run. At this point, a distance based slowdown pattern is usually substituted for the time based pattern. When the distance-to-go value from the elevator car to the target floor is based upon updating a counter with pulse wheel generated distance pulses, or when it is determined by any other method in which the car position is not absolute, it is common to switch to a hatch transducer arrangement which provides an analog landing speed pattern which starts, for example, when the elevator car reaches a point 10 inches (25.4 cm) from floor level and continues until the car has stopped level with the floor. The hatch transducer includes a pair of car mounted transformers, associated circutry, and a metallic hour glass shaped landing vane at each floor. The landing and leveling is thus under the direction of a speed pattern based on absolute car position. While excellent landings are made using the hatch transducer, it does require substantial time to adjust the landing vane at each floor, in order to produce good landings, and even then the landing pattern may vary slightly from floor to floor. Also, being analog, the circuitry is subject to drift and it requires periodic adjustment.

SUMMARY OF THE INVENTION

Briefly, the present invention relates to a new and improved elevator system, and to new and improved methods for performing certain functions of an elevator system. An up/down counter provides a count while the elevator car is located in the landing zone of the target floor which is used to generate speed patterns for accurately landing and leveling an elevator car. The counter is pre-loaded with a count equal to the length of the landing zone in terms of a predetermined standard increment defined by suitable indicia disposed in the hatchway above and below the level of each floor. Detection of the indicia while the elevator car is moving in the landing zone produces either a first or a second train of distance pulses in response to up and down movement, respectively, of the elevator car. The active pulse train is used to decrement the count on the counter when the car is moving towards the target floor in the landing zone, and to increment the count, in the event the car overshoots the floor, while the car is moving away from the target floor in the landing zone. First and second speed patterns of equal absolute magnitude but of opposite polarities are generated in response to the count, with the correct speed pattern being selected as a result of a logical combination of the active train of distance pulses, the position of the elevator car relative to the target floor, and the travel direction in which the elevator car initially approached the target floor. The speed pattern is thus produced from the digital count, and the digital count is produced by low cost solid state circuits which are easy to set up and adjust, and which are more apt to remain in adjustment than analog circuitry. The speed is generated from precise optoelectronically detected inidica disposed adjacent to each floor, such as reflective tape, which is easy to install and ajust.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

The invention relates to a new and improved elevator system, and methods for performing certain functions thereof, and more specifically to an elevator system in which distance pulses, such as from a pulse wheel, are used to generate the slowdown speed pattern, and absolute position distance pulses are used to generate the landing and leveling speed pattern. Only those portions of an elevator system which are pertinent to the understanding of the invention will be described, with the remaining portions of a complete elevator system being incorporated by reference to issued patents assigned to the same assignee as the present application. The patents incorporated by reference are U.S. Pat. Nos. 3,750,850; 4,277,825; and 4,019,606. U.S. Pat. No. 3,750,850 sets forth a car controller, including a floor selector and speed pattern generator which utilize distance pulses in their operation. An electrical distance pulse or signal is generated, such as from a pulse wheel, in response to each predetermined standard increment of car travel, such as a distance pulse for each 0.25 inch (0.635 cm) of car travel. U.S. Pat. No. 4,277,825 discloses elevator drive machine control which utilizes a speed pattern to control the speed of elevator car. U.S. Pat. No. 4,019,606 illustrates an optoelectronic arrangement which may be used to detect a reflective target disposed adjacent to each floor of a building.

Figure 1:
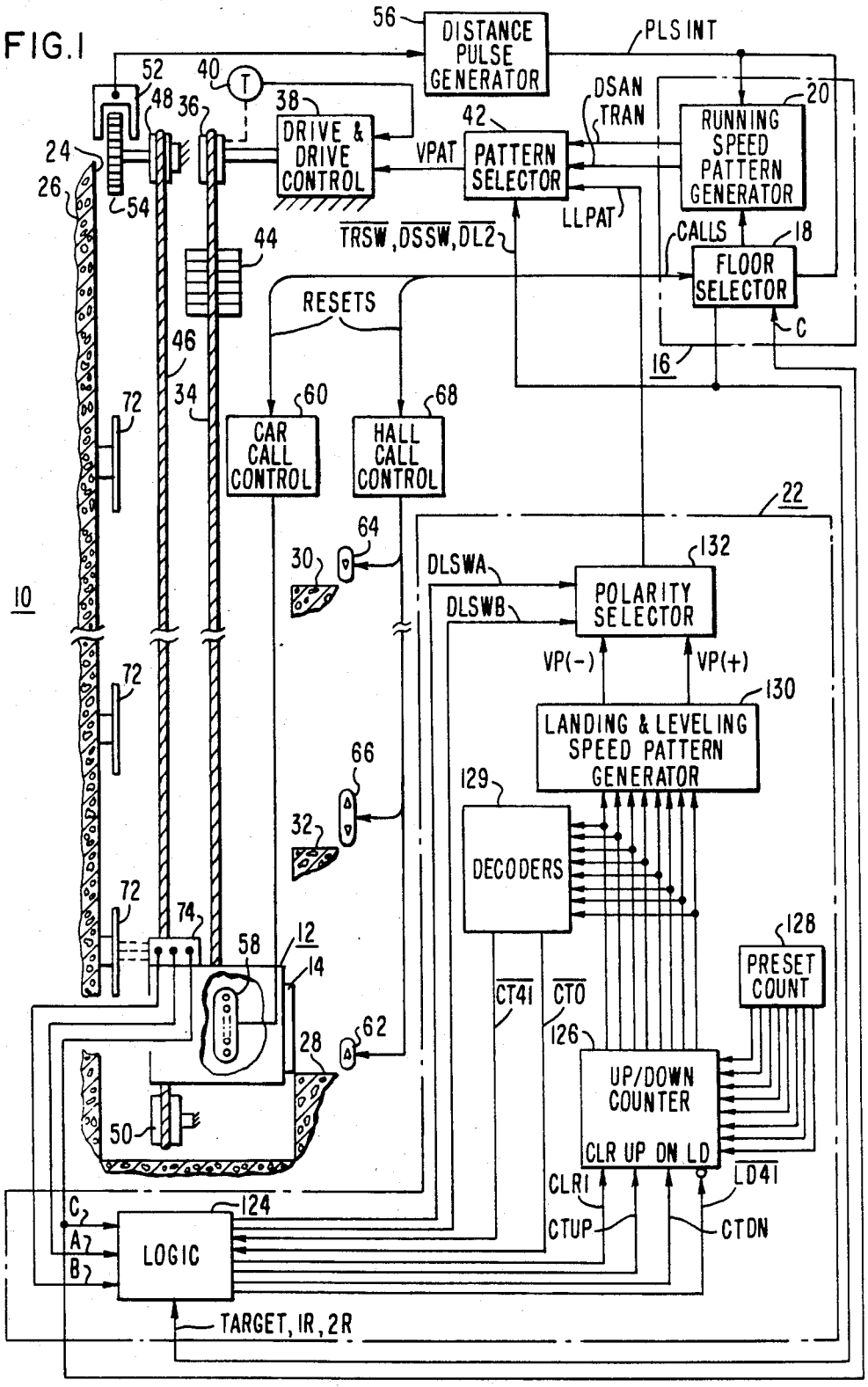
FIG. 1 is a partially schematic and partially block diagram of an elevator system constructed according to the teachings of the invention.

More specifically, FIG. 1 illustrates an elevator system 10 constructed according to the teachings of the invention. Elevator system 10 includes an elevator car 12 having a door 14. Elevator car 12 is controlled by a car controller 16. Car controller 16 includes a floor selector 18 and a running speed pattern generator 20. Car controller 16 is described in detail in the incorporated Pat. No. 3,750,850. It is sufficient for the understanding of the present invention to state that the floor selector 18, in addition to providing signals for the running speed pattern generator 20, car door control and hall lantern control (not shown), provides logic signals TARGET, 1R and 2R for a landing speed pattern generator 22. Logic signal TARGET is true when the next floor at which the elevator car can make a normal stop is the next stop for the car. The signal TARGET is provided by comparing the binary address of the AVP floor (the next floor in the direction of the elevator car at which the car can make a normal stop) with the binary address of the target floor. Logic signals 1R and 2R are responsive to the up and down running relays 1 and 2, respectively, (not shown). Signal 1R is true or at the logic 1 level for the up running direction, and signal 2R is a logic 1 for the down running direction.

Car 12 is mounted in a hatchway 24 for movement relative to a structure 26 having a plurality of floors or landings, with only the bottom floor, top floor, and one intermediate floor 28, 30 and 32, respectively, being shown, in order to simplify the drawing. Car 12 is supported by a plurality of wire ropes 34 which are reeved over a traction sheave 36 mounted on the shaft of a drive machine 38. The drive machine 38, which is the motive means for moving and stopping the elevator car, may be an AC system having an AC drive motor, or a DC system having a DC drive motor, such as used in the Ward-Leonard MG drive system, or in a solid state drive system. The drive machine 38, along with its associated closed loop feedback control, is shown in detail in incorporated U.S. Pat. No. 4,277,825. A tachometer 40 provides a signal responsive to the actual rotational speed of the drive motor of the drive machine 38, and an error amplifier in the feedback control compares the actual speed signal with the desired speed signal represented by a speed pattern signal VPAT provided by a speed pattern selector function 42. A suitable speed pattern selector function is shown in detail in incorporated U.S. Pat. No. 3,750,850.

A counterweight 44 is connected to the other ends of the ropes 34. A governor rope 46, which is connected to the car 12, is reeved over a governor sheave 48 located above the highest point of travel of the car 12 in the hatchway 24, and under a pulley 50 located in the pit at the bottom of the hatchway 24. A pick-up 52 is disposed to detect movement of the elevator car 12 to the effect of circumferentially spaced openings in the governor sheave 48, or, as illustrated, in a separate pulse wheel 54 which is rotated in response to the rotation of the governor sheave 48. The openings in the pulse wheel 54 are spaced to provide a distance pulse for each predetermined standard increment of travel of the elevator car 12, such as a pulse for each 0.25 inch of car travel. Thus, while the elevator car is moving, a train of distance pulses are provided. Pick-up 52 may be of any suitable type, such as optical or magnetic. Pick-up 30 is connected to distance pulse control 56 which provides distance pulses PLSINT for car controller 16.

Car calls, as registered by pushbutton array 58 mounted in the car 12, are processed by car call control 60, and the resulting information is directed to the car controller 16.

Hall calls, as registered by pushbuttons mounted in the hallways, such as the up pushbutton 62 located at the bottom floor 28, the down pushbutton 64 located at the top floor 30, and the up and down pushbuttons 66 located at the intermediate floors 32, are processed in hall call control 68. The resulting processed hall call information is directed to the car controller 16.

Floor selector 18 tabulates the distance pulses from the distance pulse generator 56 in an up/down counter (not shown) to develop information concerning the precise position of the car 12 in the hatchway 24, to the resolution of the predetermined standard increment. When the car 12 is located at the lowest floor, the car position count, referred to as POS16, is set to a predetermined value. The POS16 count when the car 12 is level with each floor is used as the binary address for the associated floor. These addresses or floor heights ae stored in a look-up table in a suitable read-only memory (ROM).

Floor selector 18, in addition to keeping track of the position of car 12, also tabulates the calls for service for the car, it provides signals for starting the elevator car on a run to serve a call, or calls, for elevator service, and it provides resets for the car and hall call pushbuttons when a call has been served.

As hereinbefore stated, car controller 16 develops an advanced floor position signal for the elevator car 12, referred to as the AVP floor, or simply as AVP. The advanced floor position AVP is the closest floor ahead of the elevator car 12 in its travel direction at which the car can stop according to a predetermined deceleration schedule. The floor which car 12 should stop, to serve a car call or a hall call, or simply to park, is referred to as the target floor. When the AVP of the car 12 reaches the address of the target floor, the running speed pattern generator which had been providing a time based speed pattern TRAN now initiates the slowdown phase of the run by providing a speed pattern DSAN based on the distance-to-go from the elevator car to the target floor. The car controller 16 controls the pattern selector 42 via signals $\overline{\text{TRSW}}$, $\overline{\text{DSSW}}$, and $\overline{\text{DL2}}$, which select the time based running speed pattern TRAN, the slowdown speed pattern DSAN, and the landing speed pattern LLPAT, respectively.

Figure 2:
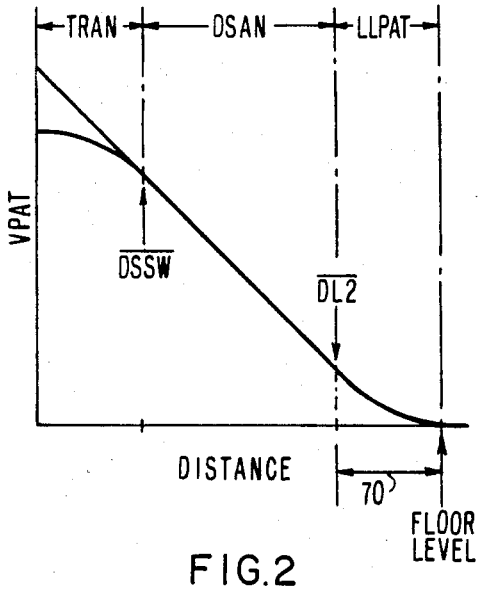
FIG. 2 is a graph illustrating different portions of a speed pattern suitable for an elevator system.

FIG. 2 is a graph which illustrates speed pattern VPAT versus distance-to-go to the target floor, starting at the initiation of the slowdown phase of the run. FIG. 2 also illustrates the high speed tranfer from the time based pattern TRAN to the distance base slowdown speed pattern DSAN via signal DSSW, and the low speed pattern transfer from pattern DSAN to the landing speed pattern LLPAT via signal $\overline{\text{DL2}}$ at a predetermined dimension 70 from the target floor, e.g., 10 inches (25.4 cm).

According to the teachings of the invention, the predetermined dimension is established by indicia 72 (FIGS. 1 and 3) disposed in the hatchway 24 adjacent to each floor served by the elevator car 12. Inidicia 72 is detected by a detector 74 mounted on the elevator car 12. In a preferred embodiment of the invention, the indicia 72 and detector 74 are provided by an optical arrangement in which the detector 74 includes suitable transmitters and receivers of electromagnetic radiation, and the indicia 72 includes a predetermined pattern of surfaces which are reflective and nonreflective of such electromagnetic radiation. For example, reflective tape may be used to establish the reflective portions of the pattern. The electromagnetic radiation may be of any desired and suitable frequency, with infrared light being especially suitable, as special shielding of visible light is not required.

Figure 3:
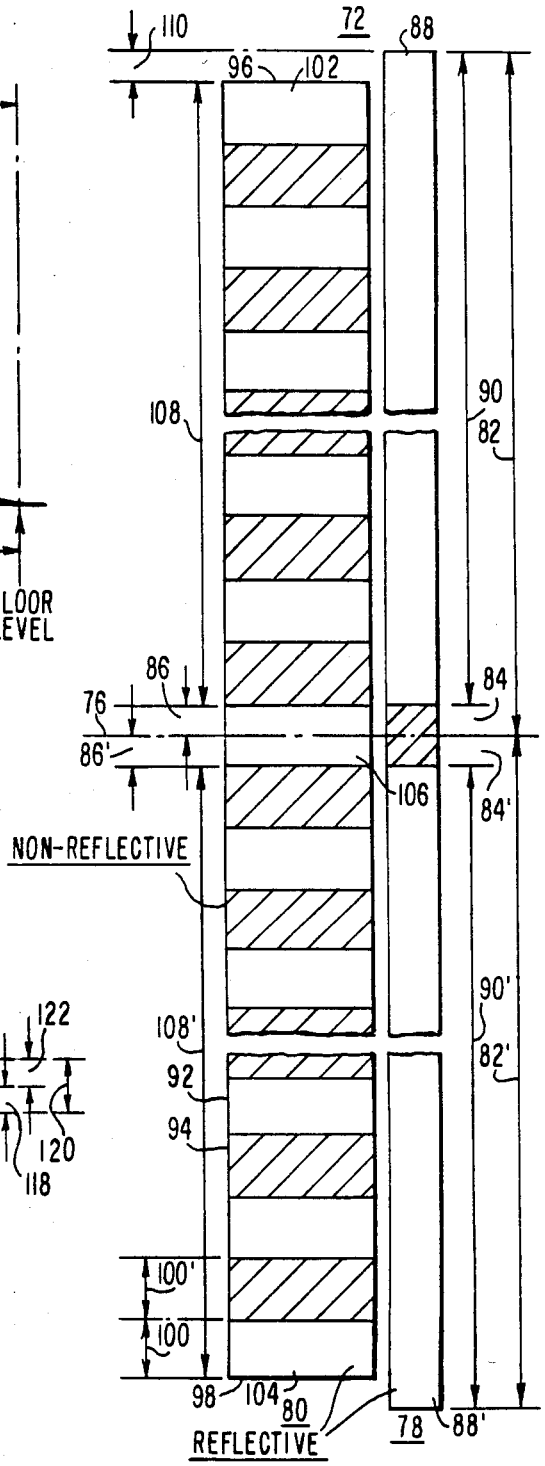
FIG. 3 is an elevational view of indicia suitable for mounting in the hatchway adjacent to each floor.

FIG. 3 illustrates indicia 72 which sets forth suitable patterns of reflective and nonreflective surfaces which may be used. The hatched portions of FIG. 3 indicate a non-reflective surface, and the non-hatched portions within the outlines of the patterns indicate reflective surfaces. Indicia 72 is symmetrical above and below floor level, with the floor level being indicated by broken line 76. Indicia 72 includes first and second horizontally spaced, vertically extending patterns 78 and 80, respectively. The first pattern 78 extends for predetermined like vertical dimensions 82 and 82' above and below, respectively, floor level 76, with the predetermined dimension being 10.5 inches (26.67 cm), for example. Pattern 78 includes a non-reflective surface 84 which starts at floor level and extends for a predetermined dimension 86 above floor level, and it includes a non-reflective surface 84' which starts at floor level and extends for a predetermined dimension 86' below floor level. Dimensions 86 and 86' may be 0.25 inch (0.635 cm), for example. Pattern 78 also includes a vertically extending reflective surface 88 which starts at the upper edge of non-reflective surface 84 and extends upwardly for a predetermined dimension 90. Pattern 78 also includes a vertically extending surface 88' which starts at the lower edge of the non-reflective surface 84', and extends downwardly for the dimension 90', which is the same as dimension 90. Dimensions 90 and 90', for example, may be 10.25 inches (26.135 cm).

The second vertically oriented reflective/non-reflective pattern 80 includes a plurality of reflective and non-reflective surfaces 92 and 94, respectively, which alternate from the top 96 to the bottom 98 of the pattern. Surfaces 92 and 94 have like predetermined vertical dimensions 100 and 100', respectively, such as 0.5 inch (1.27 cm). Pattern 80 starts at its upper and lower ends 96 and 98 with reflective surfaces 102 and 104, respectively, and a reflective surface 102 is disposed at the midpoint of the pattern, such that floor level 76 bisects the reflective surface 106. Pattern 80, from the top 96 to the upper edge of reflective surface 106, and from the bottom 98 to the lower edge of reflective surface 106, has like predetermined dimensions 108 and 108', respectively, such as 10 inches (25.4 cm). Thus, pattern 80 extends for a dimension on each side of floor level equal to the sum of dimensions 108 and 86, for a total of 10.25 inches (26.135 cm). Since dimension 82 is 10.5 inches (26.67 cm), pattern 78 extends past the top and bottom edges 96 and 98, respectively, of pattern 80, by a dimension 110, which is 0.25 inch (0.635 cm).

Figure 4:
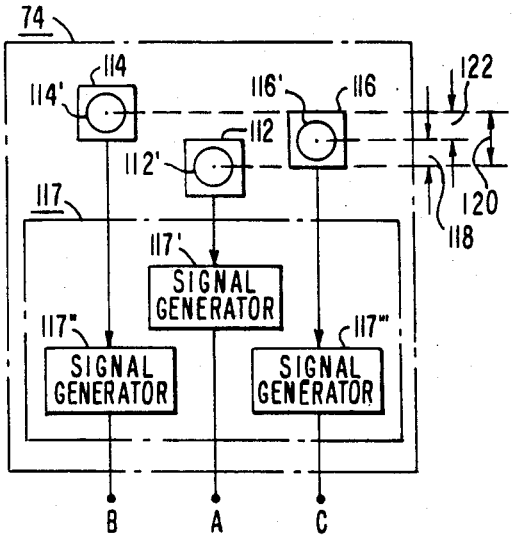
FIG. 4 is a schematic diagram which illustrates the relative locations of car mounted optoelectronic detectors for detecting the indicia shown in FIG. 3.
Figure 5:
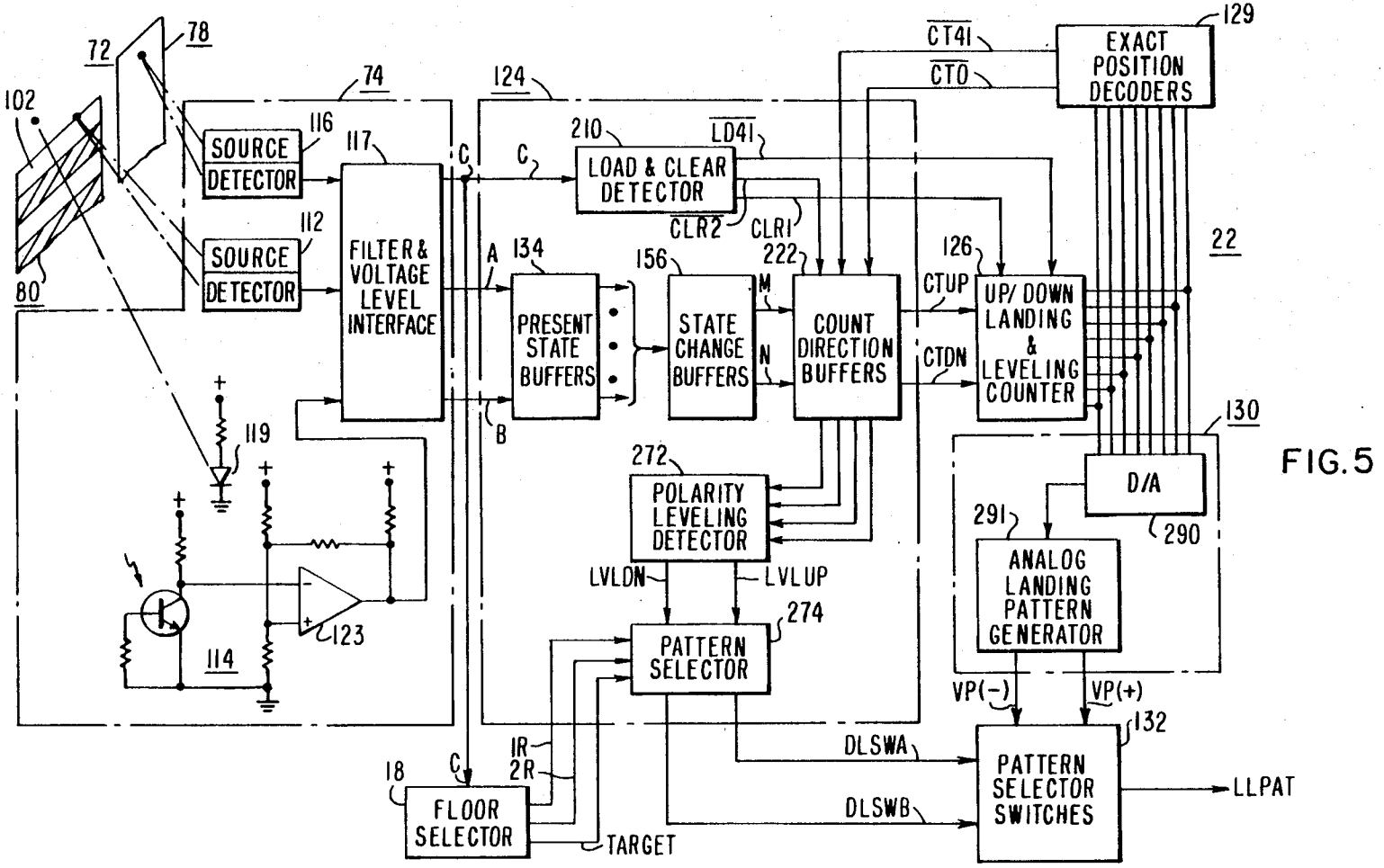
FIG. 5 is a detailed functional block diagram of the elevator system shown in FIG. 1, setting forth a preferred embodiment of the invention.

FIG. 4 illustrates an arrangement for detector 74 which develops true logic signals A, B and C in response to the detection of the reflective surfaces of indicia 72. The rectangular outlines 112, 114 and 116 each indicate an optical transmitter-receiver detector, with the circles 112', 114' and 116' indicating the location of the transmitter. For example, as shown in FIG. 5 relative to detector 114, each transmitter may include a light emitting diode 19 (LED), and the receiver may include a photo device, such as a photo transistor 121. A comparator 123 provides an output signal in response to the conductive state of the photo device. U.S. Pat. Nos. 3,743,056 and 4,019,606 illustrate suitable circuitry for such optical functions. The outputs of detectors 112, 114, and 116 are applied to signal generator functions, referred to with a common reference numeral 117. Detectors 112 and 114 are located such that they will detect the second pattern 80, and detector 116 is located to detect the first pattern 78. Using the location of transmitter 112' as a reference, transmitter 116' is disposed a predetermined dimension 118 above transmitter 112', such as 0.125 inch (0.3175 cm), and transmitter 114' is disposed a predetermined dimension 120 above transmitter 112', such as 0.25 inch (0.635 cm). Thus, transmitters 114' and 116' are vertically spaced by a dimension 122 equal to 0.125 inch (0.3175 cm). Since pattern 78 starts 0.25 inch (0.635 cm) above and below pattern 80, when the elevator car 12 is traveling in the downward direction detector 116 will detect reflective surface 88. A short time later, detector 112 will detect reflective surface 102. A short time after that, detector 114 will detect reflective surface 102. Thus, logic signals C, A and B will initially switch true in the recited sequence. When the elevator car is traveling in the upward direction, detector 116 will detect reflective surface 88'. A short time later, detector 114 will detect reflective surface 104. A short time after that, detector 112 will detect reflective surface 104. Thus, logic signals C, B and A will intially switch true in the recited sequence for the up travel direction. The logical combination of signals A and B will change every 0.25 inch (0.635 cm) of car travel, which establishes the standard increment.

The landing and leveling pattern generator 22 shown in FIG. 1 includes logic means 124 which logically relates signals A, B and C and develops distance pulses CTUP and CTDN for an up/down counter. Distance pulses CTDN are generated in response to each predetermined standard increment of car movement in the landing zone towards the target floor, with the predetermined standard increment of car movement being 0.25 inch (0.635 cm) in the example set forth relative to the indicia 72 and detector 74 shown in FIGS. 3 and 4, respectively. In like manner, distance pulses CTUP are generated in response to each predetermined standard increment of car movement away from the target floor while the car is in the landing zone. Logic means 124 additionally develops a signal $\overline{LD41}$ which loads a pre-set count, represented by block 128 in FIG. 1, into counter 126 prior to the time the elevator car reaches the landing zone of the target floor, which zone is defined by indicia 72. The value of the pre-set count is related to the vertical dimension of the landing zone, indicated by the sum of dimensions 108 and 86 in FIG. 3, in terms of the standard increment. The sum of dimensions 108 and 86 is 10.25 inches (26.135 cm), and the associated binary count using four counts per inch (2.54 cm) is 101001 (decimal 41). Logic means 124 also develops a signal CLR1 which clears or zeroes counter 126 when the elevator car 12 is level with the target floor.

Thus, when the elevator car 12 reaches the landing zone of the target floor, counter 126 has already been pre-set to the binary equivalent of decimal 41, and depending upon the location and travel direction of car 12 relative to the target floor, either a train of distance pulses CTDN, or a train of distance pulses CTUP, will clock counter 126. When the car is approaching the target floor in the landing zone defined by indicia 72, regardless of travel direction, pulses CTDN will decrement counter 126. The count should be decremented to zero by 41 distance pulses CTDN when the car reaches floor level. Signal CLR1 forces the count zero when the car reaches floor level, if for some reason it has not reached zero by the decrementing process. If car 12 overshoots the level of the target floor, distance pulses CTUP are generated, and thus the distance of the car from the target floor while it is on either side of floor level, is always accurately related to the instantaneous count value on counter 126. Exact position decoders 129 provide true signals $\overline{CT41}$ and $\overline{CT0}$ for logic means 124, responsive to the count value on counter 126. Signal $\overline{CT41}$ is true (low) when the count is equal to the binary equivalent of decimal 41, and signal $\overline{CT0}$ is true when the count is zero. The count value on the counter is applied to a landing and leveling speed pattern generator function 130 which transforms the digital count to a speed pattern having a value which is always accurately related to the precise distance of the elevator car from the target floor.

If the elevator system is such that a car set for up or down travel will proceed in the set direction in response to a speed pattern of predetermined polarity, and will proceed opposite to the set travel direction in response to a speed pattern or opposite polarity, function 130 may generate both a positive speed pattern VP (+) and a negative speed pattern VP(−) for a polarity selector function 132, and logic means 124 will provide a true signal DLSWA for function 132 when the positive speed pattern VP(+) is required, and a true signal DLSWB when the negative speed pattern VP(−) is required. The output of the polarity selector 132 is the correct landing speed pattern, which is applied to pattern selector 42.

FIG. 5 is a detailed block diagram of the landing and leveling speed pattern generator 22 shown in FIG. 1, and FIGS. 6A, 6B and 6C may be assembled to provide a detailed schematic diagram of the block diagram shown in FIG. 5. FIGS. 5, 6A, 6B and 6C will all be referred to in the following description.

Figure 6A:
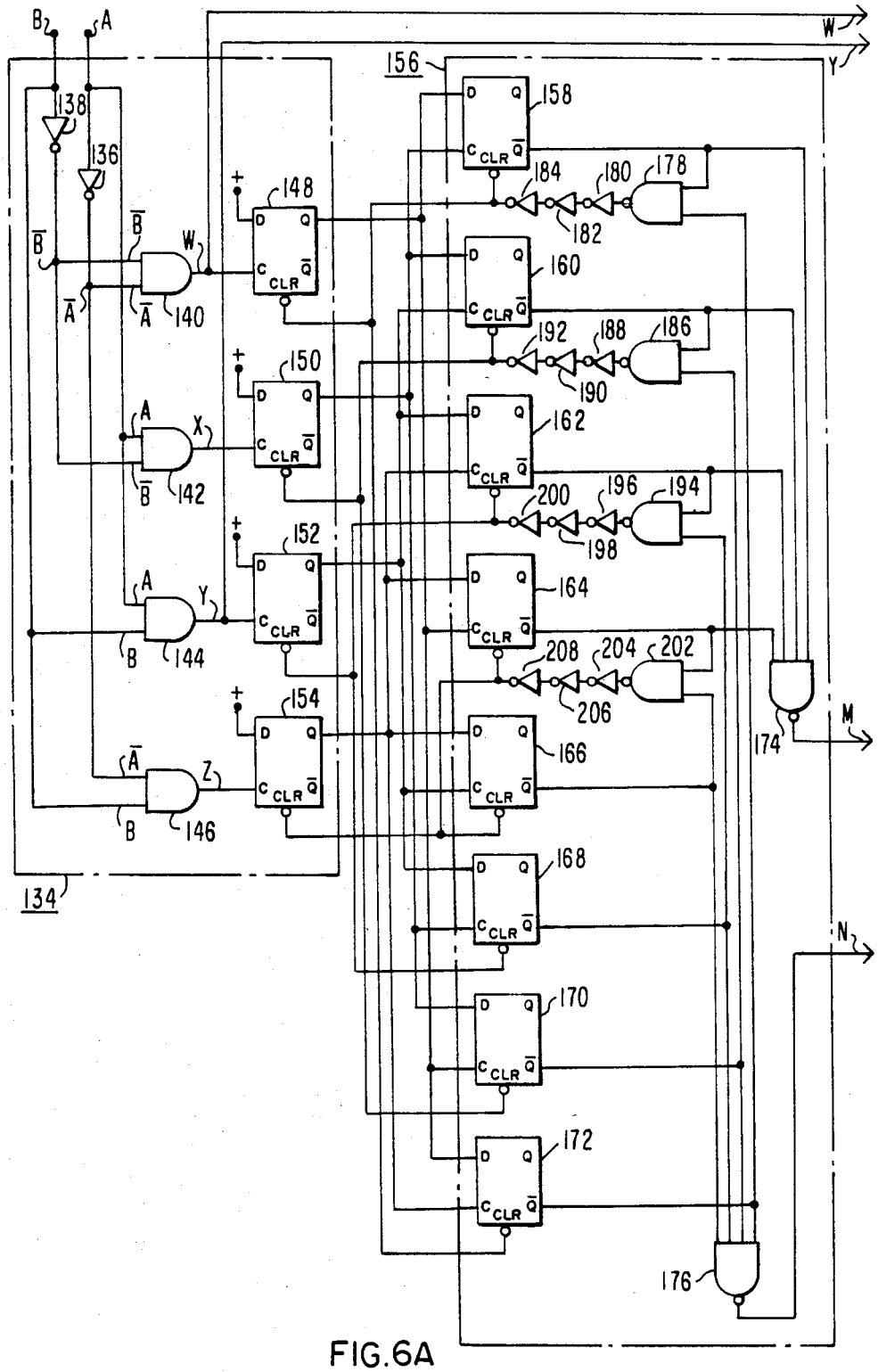
FIGS. 6A, 6B, and 6C may be assembled to provide a schematic diagram of an exemplary implementation of the system shown in block form in FIG. 5.

More specifically, the receiver portions of detectors 112, 114, and 116, develop a signal when the electromagnetic radiation emitted by the associated transmitter portion is reflected to the receiver portion by a reflective surface of the indicia 72. These signals are applied to the signal generator function 117 which includes waveform filtering and a voltage level change interface to transform the voltage levels of the detectors to the logic voltage levels required by the landing pattern generator 22. Logic signals A and B developed by detector 74 are applied to present state buffers 134. As shown in FIG. 6A, inverter gates 136 and 138 invert signals A and B, respectively, with the inverted signals $\overline{A}$ and $\overline{B}$ being applied to a dual input AND gate 140. Signals A and $\overline{B}$ are applied to an AND gate 142, signals A and B are applied to an AND gate 144, and signals $\overline{A}$ and B are applied to an AND gate 146. AND gates 140, 142, 144 and 146 provide true signals W, X, Y and Z, respectively, when their respective inputs are both at the logic 1 level. Suitable memory elements, such as D-type flip-flops 148, 150, 152 and 154, are responsive to signals W, X, Y and Z, respectively, with each flip-flop being set when its associated input signal goes true.

The Q outputs of flip-flops 148, 150, 152 and 154 are applied to state change buffers 156. As shown in FIG. 6A, the state change buffers 156 include eight memory elements, such as D-type flip-flops 158, 160, 162, 164, 166, 168, 170 and 172. The $\overline{Q}$ outputs of flip-flops 158, 160, 162 and 164 are applied to a quad input NAND gate 174, the output of which provides down travel direction pulses M in response to downward movement of car 12. In like manner, the $\overline{Q}$ outputs of flip-flops 166, 168, 170 and 172 are applied to a quad input NAND gate 176, the output of which provides uptravel direction pulses N in response to upward movement of car 12.

The Q output of flip-flop 148 is applied to the D inputs of flip-flops 158 and 172, and to the clock inputs of flip-flops 164 and 170. The Q output of flip-flop 150 is applied to the D inputs of flip-flops 160 and 170, and to the clock inputs of flip-flops 158 and 168. The Q output of flip-flop 152 is applied to the D inputs of flip-flops 162 and 168, and to the clock inputs of flip-flops 160 and 166. The Q output of flip-flop 154 is applied to the D inputs of flip-flops 164 and 166 and to the clock inputs of flip-flops 162 and 172.

The $\overline{Q}$ outputs of flip-flops 158 and 172 provide reset signals for flip-flops 158, 148, and 172 via NAND gate 178 and inverter gates 180, 182 and 184. The $\overline{Q}$ outputs of flip-flops 160 and 170 provide reset signals for flip-flops 160, 150 and 170 via NAND gate 186 and inverter gate 188, 190 and 192. The $\overline{Q}$ outputs of flip-flops 162 and 168 provide reset signals for flip-flops 162, 152 and 168 via NAND gate 194 and inverter gates 196, 198 and 200. The $\overline{Q}$ outputs of flip-flops 164 and 166 provide reset signals for flip-flops 164, 154 and 166 via NAND gate 202 and inverter gates 204, 206, and 208. The inverter gates function to delay the resetting of the associated flip-flops to provide distance pulses M and N of the desired time duration. When the elevator car 12 is outside the landing zone, all the flip-flops of the state change buffers 156 will be reset and the outputs of NAND gates 174 and 176 will both be low. Signals $\overline{A}$ and $\overline{B}$ will both be high, AND gate 140 provides a true signal W, and the Q output of flip-flop 148 will be high, enabling flip-flops 158 and 172. If the car is traveling in the up travel direction, the sequence of true signals $\overline{AB}$, AB, $A\overline{B}$, and $\overline{AB}$ will successively set and reset flip-flops 172, 166, 168 and 170, respectively, of the state change buffers 156, driving the output of NAND gate 176 successively high and low to provide a train of up travel distance pulses N (one pulse for each standard increment of car movement). If car 12 is traveling in the down travel direction, the sequence of true signals $A\overline{B}$, AB, $\overline{A}B$ and $\overline{AB}$ will successively set and reset flip-flops 158, 160, 162 and 164 of the state change buffers 156, driving the output of NAND gate 174 successively high and low to provide a train of down travel direction pulses M.

Figure 6B:
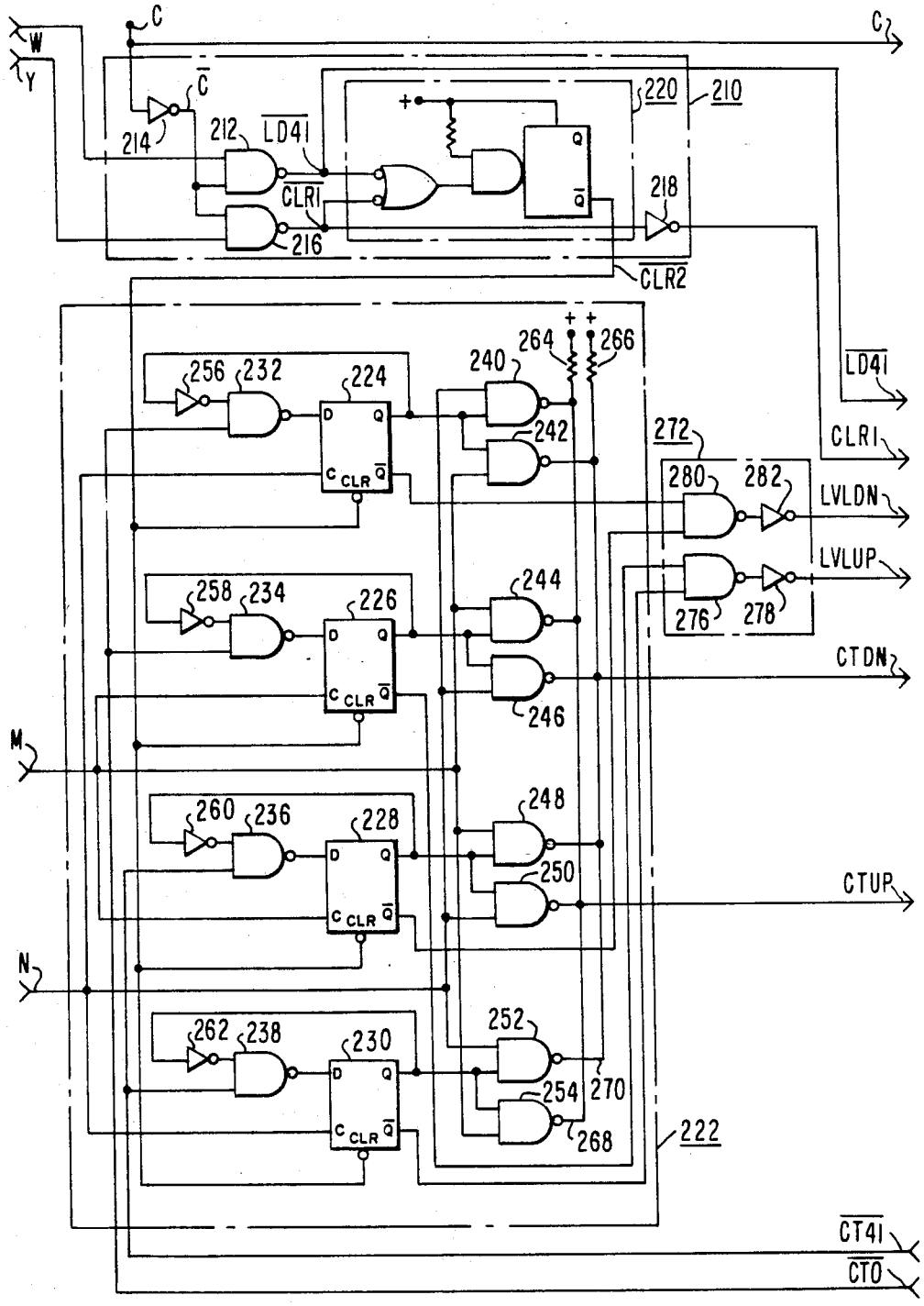

Logic signal C and the present state signals W and Y are applied to a function 210 which provides signals CLR1, $\overline{CRL2}$ and $\overline{LD41}$. Signal $\overline{LD41}$ is true when the elevator car 12 is not located within any landing zone, and it is used to preload counter 126 with the preset count. As shown in FIG. 6B, signal $\overline{LD41}$ may be provided by connecting signal W to one input of a dual input NAND gate 212, and by connecting logic signal C to the other input via an inverter gate 214 to provide a signal $\overline{C}$. Signal $\overline{C}$ is high when the car 12 is outside a landing zone, and when the car is within a landing zone ±0.25 inch (0.635 cm) relative to floor level. Signal W will not be high when the car 12 is within the ±0.25 inch zone. Both signals A and B will be high when the car is within ±0.125 inch of floor level, and signal A will be high if the car is above this zone but still within the ±0.25 inch zone, and signal B will be high if the car is below the ±0.125 inch zone but still within the ±0.25 inch zone. Thus, the output of NAND gate 212 will only provide a true (low) signal $\overline{LD41}$ when car 12 is outside all landing zones.

Signals $\overline{C}$ and Y are applied to a dual input NAND gate 216 to provide signal $\overline{CLR1}$, and signal $\overline{CLR1}$ is applied to an inverter gate 218 to provide signal CLR1 which is used to clear counter 126 when it is true. Signal Y is true when logic signals A and B are both high. Signals A and B will both be high when logic signal $\overline{C}$ is also high only when the car 12 is within ±0.125 inch of floor level. Signal $\overline{CLR2}$ is used for resetting count direction buffers within logic means 124, as will be hereinafter described. Signal $\overline{CLR2}$ is provided by a monostable multivibrator 220, such as T.I.'s SN74121.

Monostable 220 is triggered to provide a low reset pulse $\overline{CLR2}$ when either signal $\overline{LD41}$ or signal $\overline{CLR1}$ goes to a logic zero. Thus, $\overline{CLR2}$ goes true when the elevator car is outside a landing zone, and also when the elevator car is level with a floor.

Distance signals M and N are applied to count direction buffers 222, which also receive the reset signal $\overline{CLR2}$, as just described. The count direction buffers 222 determine whether distance signals M and N should decrement or increment counter 126, providing distance pulses CTDN when the counter should be decremented and pulses CTUP when it should be incremented. In addition to utilizing signals M, N and $\overline{CLR2}$, the count direction buffers 222 need to know when the elevator car 12 is outside the landing zone, and also when the car 12 is at floor level, or when it passes floor level. Signal $\overline{CT41}$ from the exact position decoder 129 is true when the car 12 is outside a landing zone, and signal $\overline{CT0}$ from the decoder 129 is true when the car 12 is at floor level, and it is also momentarily true when the elevator car passes the floor level of the target floor. These signals are logically related to provide distance pulses CTUP and CTDN via four memory elements, such as D-type flip-flops 224, 226, 228 and 230, twelve dual inputs NAND gates 232, 234, 236 238, 240, 242, 244, 246, 248, 250, 252 and 254, four inverter gates 256, 258, 260 and 262, and two resistors 264 and 266. One end of each resistor is connected to a positive source of unidirectional potential, and the remaining ends of resistors 264 and 266 are connected to buses 268 and 270 respectively. Signal CTUP is provided by a connection to bus 268, and signal CTDN is provided by a connection to bus 270.

Signal M is connected to the clock inputs of flip-flops 226 and 228 and to an input of each of the NAND gates 242, 244, 248 and 254. Signal N is connected to the clock inputs of flip-flops 224 and 230 and to an input of each of the NAND gates 240, 246, 250 and 252. Signal $\overline{CT41}$ is connected to an input of each of the NAND gates 236 and 238, and signal $\overline{CT0}$ is connected to an input of each of the NAND gates 232 and 234.

The Q output of flip-flop 224 is connected to inverter 256, the output of inverter 256 is connected to the remaining input of NAND gate 232 and the output of NAND gate 232 is connected to the D input of flip-flop 224. The Q output of flip-flop 224 is also connected to the remaining inputs of NAND gates 240 and 242.

The Q output of flip-flop 226 is connected to inverter 258, the output of inverter 258 is connected to the remaining input of NAND gate 234, and the output of NAND gate 234 is connected to the D input of flip-flop 226. The Q output of flip-flop 226 is also connected to the remaining inputs of NAND gates 244 and 246.

The Q output of flip-flop 228 is connected to inverter 260, and the output of inverter 260 is connected to the remaining input of NAND gate 236. The output of NAND gate 236 is connected to the D input of flip-flop 228. The Q output of flip-flop 228 is also connected to the remaining inputs of NAND gates 248 and 250.

The Q output of flip-flop 230 is connected to inverter 262, and the output of inverter 262 is connected to the remaining input of NAND gate 238. The output of NAND gate 238 is connected to the D input of flip-flop 230. The Q output of flip-flop 230 is also connected to the remaining inputs of NAND gates 252 and 254.

In the description of the count direction buffers 222, it will first be assumed that the car 12 is going in the up travel direction and is approaching the target floor. Flip-flops 224, 226, 228 and 230 will all be in their reset states. Signal $\overline{CT41}$ will be a logic zero, because the counter 126 will have been preset to the binary equivalent of decimal 41. Thus, flip-flops 228 and 230 will have logic 1 signals at their D inputs. When the landing zone is reached, the up direction distance pulses N will be provided, setting the enabled flip-flop 230. The high Q output of flip-flop 230 enables NAND gates 252 and 254, and the same pulse N which set flip-flop 230 drives the output of enabled NAND gate 252 low. Thus, the up direction distance pulses N result in a train of distance pulses being provided by NAND gate 252, which is connected to bus 270 and the CTDN output of the count direction buffers 222. The CTDN output is applied to the decrementing input of counter 126, decrementing the count, and thus signal $\overline{CT41}$ will go high after the first decrementing pulse. Flip-flop 230 remains enabled, however, via inverter gate 262 and the other input of NAND gate 238. When car 12 reaches floor level, the count on counter 126 will have been decremented to zero, signal $\overline{CLR2}$ from detector 210 will reset flip-flops 224, 226, 228 and 230, and signal $\overline{CT0}$ will be low, enabling flip-flops 224 and 226. If car 12 overshoots the target floor, it will still be traveling in the up travel direction and pulses N will still be provided. The first pulse N produced by overtravel sets the enabled flip-flop 224, which in turn enables NAND gates 240 and 242. This same initial pulse is passed to bus 268 and the CTUP output via NAND gate 240. As long as car 12 continues to travel up, away from the target floor in the landing zone, its position relative to floor level will be accurately kept on counter 126, as the signal CTUP will increment the count on counter 126. When car 12 stops and levels downwardly, back to floor level, down direction distance pulses M will be provided. Flip-flop 224 will still be set, and thus pulses M are passed to bus 270 and the CTDN output via the enabled NAND gate 242. The CTDN pulses will decrement counter 126 back to zero as the car levels into floor level.

It will now be assumed that car 12 is going in the down travel direction and is approaching the target floor. The flip-flops 224, 226, 228 and 230 will all be in their reset states. Signal $\overline{CT41}$ will be a logic zero, because counter 126 will have been preset to the binary equivalent of decimal 41. Thus, flip-flops 228 and 230 will have logic 1 signals at their D inputs. When the landing zone is reached, the down direction distance pulses M will be provided, setting the enabled flip-flop 228. The high Q output of flip-flop 228 enables NAND gates 248 and 250, and the same pulse M which set flip-flop 228 drives the output of enabled NAND gate 248 low. Thus, the down direction distance pulses M result in distance pulses being provided by NAND gate 248 which is connected to bus 270 and the CTDN output of the count direction buffers 222. The CTDN output is applied to the decrementing input of counter 126, decrementing the count, and thus signal $\overline{CT41}$ will go high after the first pulse. Flip-flop 228 remains enabled, however, via inverter 260 and the other input of NAND gate 236. When car 12 reaches floor level, the count on counter 126 will have been decremented to zero, signals $\overline{CLR2}$ from detector 210 will reset flip-flops 224, 226, 228 and 230, and signal $\overline{CT0}$ will be low, enabling flip-flops 224 and 226. If the car overshoots the target floor, it will still be traveling in the down travel direction and pulses M will still be provided. The first pulse M produced by over travel sets the enabled flip-flop 226 which enables NAND gates 244 and 246, and this same first pulse is passed to bus 268 and the CTUP output via NAND gate 244. As long as car 12 continues to travel down, away from the target floor in the landing zone, its position relative to floor level will be accurately maintained on counter 126, as the signal CTUP will increment the count on counter 126. When the car stops and levels upwardly, back to floor level, up distance pulses N will be provided. Flip-flop 226 will still be set, and thus the distance pulses N are passed to bus 270 and the CTDN output via the enabled NAND gate 246. The CTDN pulses will decrement counter 126 back to zero as the car levels into floor level.

In addition to providing count direction pulses CTUP and CTDN for counter 126, the count direction buffers 222 provide signals for a polarity leveling detector function 272. The polarity leveling function 272 provides signals LVLUP and LYLDN for a pattern selector function 274. Signal LVLUP is true when the car 12 should be leveling in the up travel direction, and signal LVLDN is true when the car should be leveling in the down travel direction.

Signal LVLUP is provided by the $\overline{Q}$ outputs of flip-flops 226 and 230, an AND gate 276, and an inverter gate 278. When car 12 is traveling upwardly, approaching the target floor in its landing zone, flip-flop 230 is set, AND gate 276 outputs a logic zero which is inverted to a true signal LVLUP by inverter 278. If the car 12 is traveling in the down travel direction and it overshoots the target floor, flip-flop 226 will be set, and again, AND gate 276 and inverter gate 278 will provide a true signal LVLUP.

Signal LVLDN is provided by the $\overline{Q}$ outputs of flip-flops 224 and 228, an AND gate 280, and an inverter gate 282. When the car 12 is traveling downwardly, approaching the target floor in its landing zone, flip-flop 228 is set, AND gate 280 outputs a logic zero which is inverted to a true signal LVLDN by inverter 282. If car 12 is traveling upwardly and it overshoots the target floor, flip-flop 224 will be set, and again, AND gate 280 and inverter gate 282 will provide a true signal LVLDN.

Figure 6C:
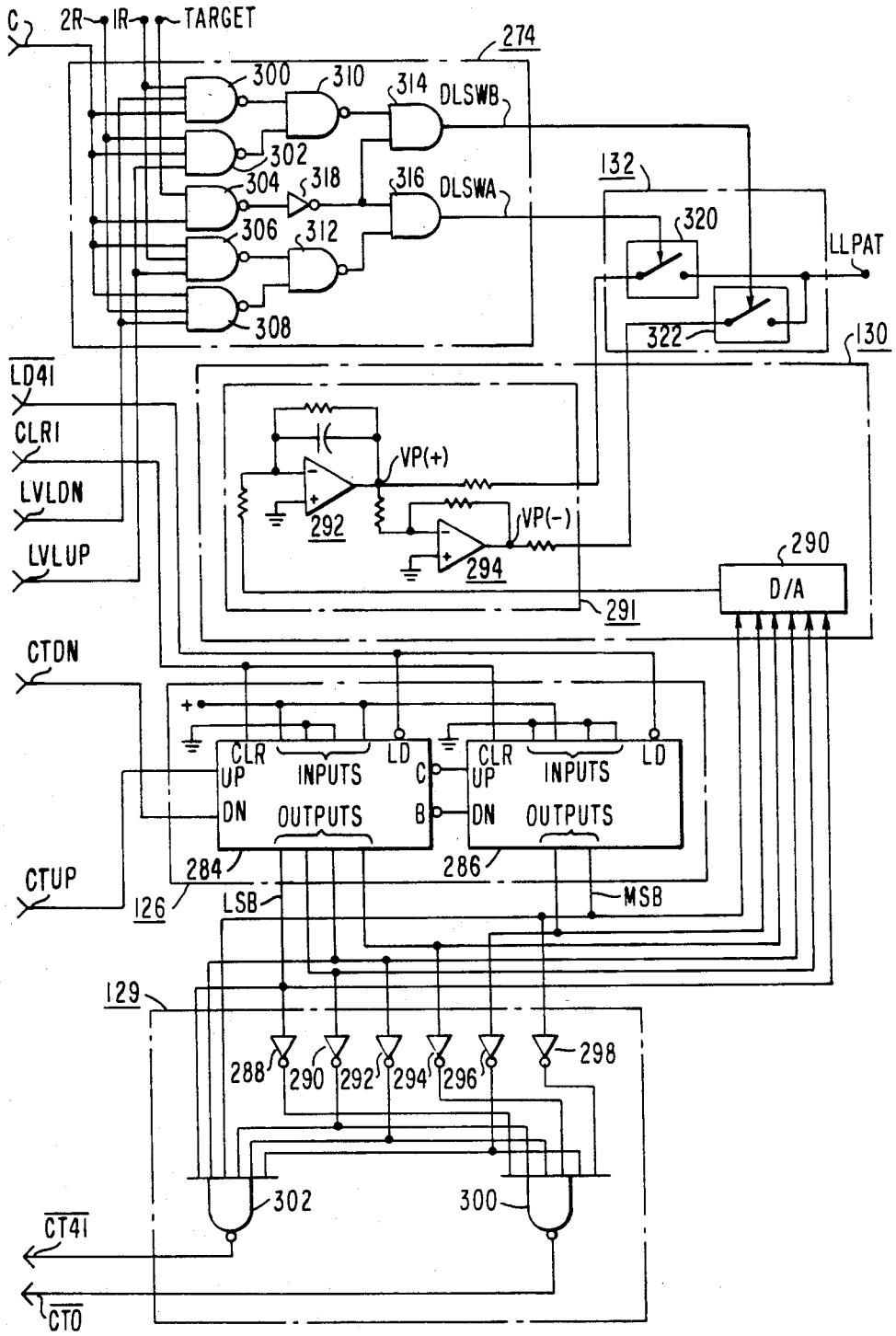

Turning now to FIG. 6C, the up/down counter 126 may be provided by first and second synchronous, four-bit binary bit up/down counters 284 and 286, respectively, such as T.I.'s SN74193 connected in cascade. The up and down count direction inputs of counter 284 are connected to receive distance pulse signals CTUP and CTDN, respectively, the carry and borrow outputs of counter 284 are connected to the up and down count direction inputs of counter 286, the data inputs of the cascaded counters are preset to the binary equivalent of decimal 41 (00101001), the clear inputs of the counters are connected to receive signal CLR1, and the load inputs are connected to receive signal $\overline{LD41}$. The data outputs of counters 284 and 286 are connected to the exact position decoders 129. The exact position decoders 129 include six inverter gates 288, 290, 292, 294, 296 and 298, each having an input connected to an output of the counters 284 and 286, and two NAND gates 300 and 302. The outputs of the inverter gates are all connected to an input of NAND gate 300, the output of which provides signal $\overline{CT0}$. The inputs of NAND gate 302 are connected such that its output goes low to provide a true signal $\overline{CT41}$ when the output count of counters 284 and 286 is 00101001.

The data outputs of counters 284 and 286 are also connected to the function 130 which provides an analog landing speed pattern in response to the output count on counter 126. Since the output count is the exact distance to go to the floor in terms of the standard increment, the count value may use the same speed pattern generator function which provided the slowdown pattern, or a similar function, based on the square root of the distance-to-go, such as disclosed in U.S. Pat. No. 3,750,850, or in the digital speed pattern generator disclosed in Application Ser. No. 446,149 filed Dec. 2, 1982. The output count of counter 126 may also be used to address a read-only memory (ROM) having the values of the desired landing speed pattern stored therein for each position of the elevator car in the landing zone, using the standard increment to determine the different positions which provide a new address for the ROM, such as disclosed in Application Ser. No. 509,117 filed June 29, 1983, Application Ser. No. 523,994 filed Aug. 17, 1983, or in U.S. Pat. Nos. 4,046,229 and 4,102,436.

For purposes of example, a pattern generator function which may be used for function 130 is set forth in FIG. 6C. The digital output of counter 126 is applied to a digital-to-analog converter (D/A) 290 and the analog output is filtered and amplified in an analog pattern generator function 291 which includes an amplifier 292, the output of which provides a positive landing speed pattern VP(+). The output of amplifier 292 is applied to an inverting amplifier 294 to provide a negative landing speed pattern VP(−). The pattern selector 274 and the polarity selector 132 select which polarity pattern should be connected to the output terminal LLPAT at any instant.

A pattern selector which may be used for the selector function 274 is shown in FIG. 6C. It utilizes logic signal C, the leveling direction signals LVLDN and LVLUP provided by the polarity leveling detector 272, the up and down running direction signals 1R and 2R, respectively, provided by the floor selector, and the signal TARGET which is provided by the floor selector to indicate when the floor being approached by the elevator car is the floor at which the car 12 should stop. Function 274 includes seven NAND gates 300, 302, 304, 306, 308, 310 and 312, two AND gates 314 and 316, and an inverter gate 318. NAND gate 304 and inverter gate 318 are used to enable AND gates 314 and 316 when car 12 is in a landing zone, indicated by C being true, of the target floor, indicated by signal TARGET being true. AND gate 316 provides signal DLSWA which selects the positive pattern VP(+), and AND gate 314 provides a signal DLSWB which selects the negative pattern VP(−).

Signal C is connected to the input of all of the NAND gates 300, 302, 304, 306 and 308, the down leveling direction signal LVLDN is connected to inputs of NAND gates 300 and 308, the up leveling direction signal LVLUP is connected to inputs of NAND gates 302 and 306, the up running direction signal 1R is connected to inputs of NAND gates 300 and 306, and the down running direction signal 2R is connected to inputs of NAND gates 302 and 308. The outputs of NAND gates 300 and 302 are connected to inputs of NAND gate 310, and the output of NAND gate 310 is connected to the remaining input of AND gate 314. The outputs of NAND gates 306 and 308 are connected to inputs of NAND gate 312, and the output of NAND gate 312 is connected to the remaining input of AND gate 316.

The logic of the pattern selector 274 is based upon the assumption that when the up running direction relay is energized, i.e., signal 1R is true, the elevator car will run in the up direction when a positive speed pattern is provided, and in the down direction when a negative speed pattern is provided. In like manner, when the down running direction relay is energized, i.e., signal 2R is true, the car will run in the down direction when a positive speed pattern is provided, and in the up direction when a negative speed pattern is provided. It will first be assumed that the running direction is up, enabling NAND gates 300 and 306, and that the car is in a landing zone, approaching the level of a target floor. Thus, the leveling direction signal LVLUP will be true and NAND gate 306 will output a logic zero driving the output of NAND gate 312 high, which results in AND gate 316 providing a true signal DLSWA which selects the positive speed pattern VP(+). If the up traveling car overshoots the floor, signal LVLDN will go true and the output of NAND gate 300 will go low, the output of NAND gate 310 will go high, and AND gate 314 will provide a true signal DLSWB which selects the negative landing speed pattern VP (−), which will then return the car to floor level.

If the car's running direction is down, and the car is in a landing zone approaching the level of a target floor, signals 2R, C, and LVLDN will be true, the output of NAND gate 300 will be low, the output of NAND gate 312 will be high and AND gate 316 will provide a true signal DLSWA which selects the postive pattern VP(+). If the down traveling car overshoots the floor, signal LVLUP will become true, the output of NAND gate 302 will go low, the output of NAND gate 310 will go high, and AND gate 314 will provide a true signal DLSWB which selects the negative speed pattern VP(−), returning the elevator car to the level of the floor.

The polarity selector function 132 may include bilateral solid state switches 320 and 322, such as RCA's CD4016. Switch 320 connects the positive pattern VP(+) to the output terminal LLPAT, with its control input being connected to receive signal DLSWA. Switch 322 connects the negative speed pattern VP(−) to the output terminal LLPAT, with its control input being connected to receive signal DLSWB.

In summary, there has been disclosed a new and improved elevator system, and methods of performing certain functions thereof, in which a landing speed pattern is provided by indicia disposed adjacent to each floor, a detector of the indicia on the car which provides distance pulses related to car movement in the landing zone defined by the indicia, an up/down counter, and logic means for incrementing and decrementing the counter to provide a count value which always indicates the precise absolute position of the elevator car in the landing zone, to the resolution of a predetermined standard increment. The logic means maintains the count regardless of initial running direction, and regardless of whether the car is approaching floor level during the intial landing, leaving floor level when the car overshoots the landing, or returning to floor level after overshooting.

I claim as my invention:

1. An elevator system, comprising:

a building having a plurality of floors, an elevator car mounted for movement in said building to serve the floors, motive means for moving said elevator car and for stopping said elevator car at a target floor, zone means establishing a landing zone having a predetermined dimension on each side of each floor, zone detector means on said elevator car for detecting the zone means of a target floor and for providing predetermined signals in response thereto, logic means responsive to the predetermined signals provided by said zone detector means, said logic means providing distance pulses related to both a predetermined standard increment of car movement and car travel direction, an up/down counter, counter preset means for presetting said counter, before the elevator car enters the landing zone of a target floor, to a count value related to said predetermined landing zone dimension in terms of said standard increment, count direction means for providing count direction signals indicative of car movement and whether the elevator car, when in the landing zone of a target floor, is moving towards or away from the target floor, said counter being responsive to said count direction signals, with said counter being decremented by said count direction signals when the elevator car is moving towards the target floor, and incremented by said count direction signals when the elevator car is moving away from the target floor, and speed pattern means providing a speed pattern for said motive means in response to the count on said counter.

2. The elevator system of claim 1 including leveling direction means providing leveling direction signals indicative of the direction the car should level, at any instant, while in the landing zone of a target floor, and wherein the speed pattern means provides a speed pattern in response to the count on the counter and also to said leveling direction signals.

3. The elevator system of claim 2 wherein the speed pattern means includes means for providing first and second speed patterns of opposite polarity in response to the count on the counter, and means providing signals for selecting one of said first and second speed patterns in response to the leveling direction signals and to the travel direction in which the elevator car initially approached the target floor.

4. The elevator system of claim 1 wherein the zone means includes reflectors and non-reflectors of electromagnetic radiation, alternately arranged in the direction of movement of the elevator car, and the zone detector means includes optical means having a source of electromagnetic radiation and a receiver therefore, for detecting said reflectors and non-reflectors of electromagnetic radiation.

5. The elevator system of claim 1 wherein the logic means provides a first train of distance pulses when the elevator car is moving in the up travel direction and a second train of distance pulses when the elevator car is moving in the down travel direction.

6. The elevator system of claim 5 wherein the count direction signals provided by the count direction means is a third pulse train when the counter should be decremented and a fourth pulse train when it should be incremented, with the third and fourth pulse trains each being producible by either of the first and second pulse trains.

7. The elevator system of claim 2 wherein the leveling direction signals are responsive to the car travel direction information included in the distance pulses and to whether or not the car is moving towards or away from a target floor in the landing zone of the target floor.

8. An elevator system, comprising:

a building having a plurality of floors, an elevator car mounted for movement in said building to serve the floors, motive means for moving said elevator car and for stopping said elevator car at a target floor, zone means establishing a landing zone having a predetermined dimension on each side of each floor, detector means on said car for detecting said zones means and for providing predetermined signals in response thereto, logic means responsive to the predetermined signals provided by said detector means, for providing distance pulses related to a standard increment of car movement and to car travel direction, an up/down counter, means presetting said counter, before the car enters the landing zone of a target floor, to a digital count value equal to the predetermined dimension of said landing zone in terms of the standard increment, means for decrementing said counter in response to said distance pulses, as the car approaches a target floor in the landing zone, and for incrementing the counter in response to said distance pulses in the event the car overshoots the floor and travels away from floor level, and speed pattern means responsive to the count on said counter for providing a speed pattern signal for said motive means having the proper polarity to land the car at a target floor, and to level the car in the event it travels past the target floor.

9. A method of generating a landing and leveling speed pattern for accurately stopping an elevator car at a target floor, comprising the steps of:

providing relative motion between the elevator car and indicia disposed to define a landing zone which extends for a predetermined dimension above and below each floor to be served by the elevator car, developing distance pulses from said relative motion, each indicative of a predetermined standard increment of car movement, loading an up/down counter with a predetermined count, prior to entering the landing zone of the target floor, with said predetermined count being related to the predetermined dimension of the landing zone in terms of the standard increment, decrementing the count on the up/down counter with the distance pulses when the elevator car is moving towards the target floor in the landing zone, incrementing the count on the up/down counter with the distance pulses when the elevator car is moving away from the target floor in the landing zone, and developing a speed pattern responsive to the count on said up/down counter.

10. The method of claim 9 wherein the step of developing the speed pattern provides first and second speed patterns of equal absolute value but of opposite polarities, and including the step of selecting the speed pattern having the polarity which will run the elevator car towards the level of the target floor.

11. The method of claim 9 wherein the step of developing distance pulses provides a first pulse train responsive to upward movement of the elevator car and a second pulse train responsive to downward movement, said first pulse train decrementing the counter during up travel of the elevator car in the landing zone towards the target floor, and incrementing the counter in the event the car passes floor level and travels away from the target floor, said second pulse train decrementing the counter during down travel of the elevator car in the landing zone towards the target floor and incrementing the counter in the event the car passes floor level and travels away from the target floor.

12. The method of claim 11 including the steps of generating car position signals indicative of whether the car, when in the landing zone of the target floor, is moving towards or away from the target floor, and logically combining the car position signals with the active pulse train of the first and second pulse trains to provide signals indicative of the correct leveling direction at any instant.

13. The method of claim 12 wherein the step of developing the speed pattern provides first and second speed patterns of equal absolute magnitude but of opposite polarities, and including the step of logically combining the signals indicative of the correct leveling direction with the travel direction of the elevator car when it initially approached the target floor to provide signals which select one of the first and second speed patterns.

* * * * *